US011834820B2

(12) United States Patent
Diao

(10) Patent No.: US 11,834,820 B2
(45) Date of Patent: Dec. 5, 2023

(54) FLOW GUIDE ASSEMBLY AND WATER SEAL FLOOR DRAIN

(71) Applicant: Qingfang Diao, Zhejiang (CN)

(72) Inventor: Qingfang Diao, Zhejiang (CN)

( * ) Notice: Subject to any disclaimer, the term of this patent is extended or adjusted under 35 U.S.C. 154(b) by 0 days.

(21) Appl. No.: 18/091,601

(22) Filed: Dec. 30, 2022

(65) Prior Publication Data

US 2023/0212849 A1 Jul. 6, 2023

(30) Foreign Application Priority Data

Dec. 30, 2021 (CN) ..... 202123420529.3

(51) Int. Cl.
*E03F 5/04* (2006.01)
*E03F 5/06* (2006.01)

(52) U.S. Cl.
CPC ..... *E03F 5/0407* (2013.01); *E03F 5/06* (2013.01)

(58) Field of Classification Search
CPC ..... E03F 5/0407; E03F 5/06
USPC ..... 4/679, 688, 286, 288, 293–295
See application file for complete search history.

(56) References Cited

U.S. PATENT DOCUMENTS

2020/0308818 A1* 10/2020 Chen ..... E03F 5/0407

FOREIGN PATENT DOCUMENTS

CN 109763557 A 5/2019
CN 113293843 A * 8/2021 ..... E03F 5/0407

* cited by examiner

*Primary Examiner* — Tuan N Nguyen
(74) *Attorney, Agent, or Firm* — COOPER LEGAL GROUP, LLC

(57) ABSTRACT

The present application relates to the technical field of a bathroom equipment, and particularly to a flow guide assembly and water seal floor drain. The water seal floor drain includes a floor drain seat, a floor drain cover, a fixing body, a water seal body assembly, a lifting rod and a sealing cover, in which an upper end of the lifting rod is slidably connected to the water seal body assembly, and an upper end of the sealing cover is rotationally connected at a center to the lifting rod. The flow guide assembly further includes a guide component provided at a side of the sealing cover departing from the lifting rod. A lower surface of the guide component acts as a second guide surface, and is configured to bulge downward. In addition, the present application relates to a flow guide assembly for guiding the flow of a fluid.

6 Claims, 6 Drawing Sheets

FLOW GUIDE ASSEMBLY AND WATER SEAL FLOOR DRAIN

CROSS-REFERENCE TO RELATED APPLICATION

The present application is based on and claims the priority benefit of China application No. 202123420529.3, filed on Dec. 30, 2021. The entirety of China application No. 202123420529.3 is hereby incorporated by reference herein and made a part of this specification.

TECHNICAL FIELD

The present application relates to the technical field of bathroom equipment, and particularly to a flow guide assembly and water seal floor drain.

BACKGROUND ART

A water seal is an essential part of a bathroom equipment, and structure rationality of the water seal can directly influence drainage performance of the bathroom equipment. In particular, China patent application no. CN201910130227.0 provides a new type water-seal-type floor drain, in which a water outlet and a sealing cover are rectangular, so that a gap between a long side of the sealing cover and an inner wall of drain is effectively increased, thereby increasing size of drainage channel and in turn efficiency of the drainage and avoiding problems of difficult drainage and clogging. Moreover, a chute and a lifting rod are arranged in a prismatic pattern, so as to ensure that the sealing cover has the same direction as that of the water outlet, avoiding problem of seal failure due to rotation of the sealing cover and further improving supportability. Meanwhile, the water outlet can be further enlarged by inclining and turning the sealing cover, so as to improve drainage efficiency.

However, during actual use, it is be found that, for the sealing cover provided China patent application no. CN201910130227.0, designed as being flat, during use, an upward air flow will be caused in the drainpipe due to the existence of air in the drainpipe, so that the sealing cover is frequently lifted by the air flow and the sealing cover fails to open or can be opened only by a small angle, leading to reduced water drainage. That is, an actual use effect of the new type of water seal floor drain provided in the above patent application is reduced.

SUMMARY

In view of this, in order to solve the problem that an upward air flow in a water pipe of a drain will press the sealing cover, the present application provides a flow guide assembly and a water seal floor drain.

In a first aspect, the present application provides a flow guide assembly, including a body, a holding part, a sliding component, a lifting rod, a sealing cover and a guide component. The body is hollow and provided with a plurality of first guiding surfaces bulging inwardly. The body has open first and second ends, the holding part is positioned in the body and connected to the first end of the body, and the sliding component is connected to the holding part. The lifting rod is provided in the sliding component. A lower end of the lifting rod is connected to a first side of the sealing cover, and a second side of the sealing cover is provided with a guide component. A surface of the guide component away from the sealing cover acts as a second guide surface, and is configured to bulge toward a direction away from the sealing cover.

In some embodiments, the second guide surface bulges as V-shaped, spherical, ellipsoidal, conical forms or the like.

In some embodiments, the lifting rod is configured to slide up and down in the sliding component.

In some embodiments, the lifting rod is configured as T-shape and sleeved with a mechanical or electromagnetic pulling structure.

In some embodiments, the pulling structure is spring.

In some embodiments, the first end of the body has a sectional area greater than that of the second end.

In some embodiments, a sidewall of the second end is recessed toward an axis of the body.

In some embodiments, opposite sidewalls of the second end of the body are symmetrically recessed toward the axis of the body.

In a second aspect, the present application provides a water seal floor drain including:

a floor drain seat;

a floor drain cover provided at top of the floor drain seat;

a fixing body connected to bottom of the floor drain seat and provided with a strainer;

a water seal body assembly inserted into the fixing body and positioned under the strainer;

a lifting rod having an upper end slidably connected with the water seal body assembly;

a sealing cover having an upper central portion rotationally connected with the lifting rod, wherein the sealing cover is configured to rotate around an axis in a first direction relative to the lifting rod; and further including:

a guide component provided at a side of the sealing cover departing from the lifting rod, wherein a lower surface of the guide component acts as a second guide surface and is configured as a convex structure bulging downward.

In some embodiments, the second guide surface has at least one convex portion and at least one inclined plane, and the convex portion is connected to the inclined plane.

In some embodiments, the convex portion is positioned at a first side of the lifting rod; and at least one part of the inclined plane is positioned at a second side of the lifting rod.

In some embodiments, a width of upper end of the guide component along the first direction is greater than that of lower end of the guide component along the first direction; and a maximum distance from the convex portion to the sealing cover is greater than that from the inclined plane to the sealing cover.

In some embodiments, an upper surface of the guide component has an area not less than that of a bottom of the sealing cover.

In some embodiments, the second guide surface is composed of one curved surface and/or one plane.

In some embodiments, the second guide surface is composed of multiple curved surfaces and/or multiple planes.

In some embodiments, the water seal body assembly is provided with a chute at a center of the water seal body assembly, and the lifting rod is provided in the chute.

In some embodiments, an upper central part of the sealing cover is provided with an articulated base, and the articulated base is formed with a rotating hole, which is hinged to a lower end of the lifting rod via a pin shaft.

In some embodiments, the water seal floor drain can be switched among a first state, a second state and a third state; in which when the water seal floor drain is in the first state, the upper end of the lifting rod is positioned at upper end of the chute; the sealing cover and the guide component are horizontal;

when the water seal floor drain is in the second state, the upper end of the lifting rod is slid to the lower end of the chute; and the sealing cover and the guide component are horizontal; and when the water seal floor drain is in the third state, the upper end of the lifting rod is slid to the lower end of the chute; and the sealing cover and the guide component are inclined.

Comparing with existing technology, the present application can achieve as least one of the following beneficial effects.

(1) The guide component/assembly provided in the present application can be used for guiding a fluid (such as air or liquid) in a restricted space, which can improve fluid speed and reduce interference or adverse effect of air flowing counter currently.

(2) The water seal floor drain provided in the present application can solve the problem that the upward air flow presses the sealing cover during draining. The guide component can split the upward air flow, so that pressure of the sealing cover suffered from the upward air flow can be reduced, the sealing cover can be opened easily, the opening size of the sealing cover can be ensured, and a smooth drainage can be achieved.

DETAILED DESCRIPTION

Figure 1:
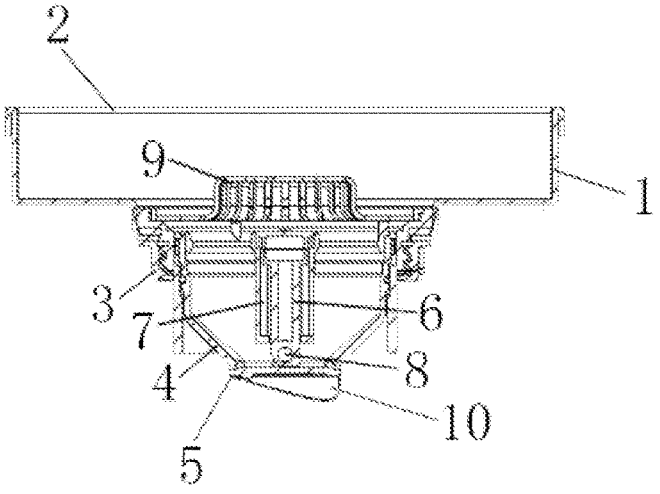
FIG. 1. is a diagram showing a guide component in a first state according to an embodiment.

The present application will be further described in details below in combination with the accompanying drawings and particular embodiments, but not limited thereto.

Embodiment 1

As shown in FIGS. 1-6, a water seal floor drain according to an embodiment is provided, including a floor drain seat 1, a floor drain cover 2, a fixing body 3, a water seal body assembly 4, a lifting rod 6 and a sealing cover 5.

In particular, the floor drain cover 2 is provided on top of the floor drain seat 1; the fixing body 3 is connected to a bottom of the floor drain seat 1 and provided with a strainer 9; the water seal body assembly 4 is inserted into the fixing body 3 and positioned under the strainer 9; a top end of the lifting rod 6 is slidably connected to the water seal body assembly 4; and a upper central part of the sealing cover 5 is rotationally connected to the lifting rod 6.

The sealing cover 5 can be rotated around an axis in a first direction relative to the lifting rod 6.

The water seal floor drain further includes a guide component 10 provided at a side of the sealing cover 5 departing from the lifting rod 6. a lower surface of the guide component 10 acts as a second guide surface, which assumes a convex structure facing downward.

Further, disordered thick lines in FIGS. 1-6 show water flow directions, and disordered thin lines show air flow directions.

Further, in some embodiments, the second guide surface has at least one convex portion and at least one inclined plane; and the convex portion is connected to the inclined plane.

Further, the inclined plane refers to a plane with a tendency to incline relative to the horizontal, but not intended to be strictly defined as a smooth surface or unsmooth surface in terms of a inclined plane, and may have a certain degree of irregulations, but roughly remain inclined from a macro perspective.

Further, in some embodiments, the convex portion is positioned at a first side of the lifting rod 6, and at least one part of the inclined plane is positioned at a second side of the lifting rod 6.

Further, in some embodiments, a width of upper end of the guide component 10 along the first direction is greater than that of the lower end of the guide component 10 along the first direction; and A maximum distance from the convex portion to the sealing cover 5 is greater than that from the inclined plane to the sealing cover 5.

Figure 2:
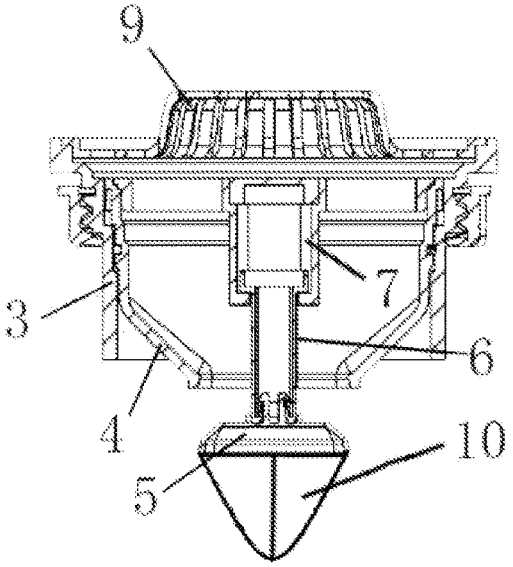
FIG. 2 is a diagram showing a guide component in a second state according to an embodiment.
Figure 3:
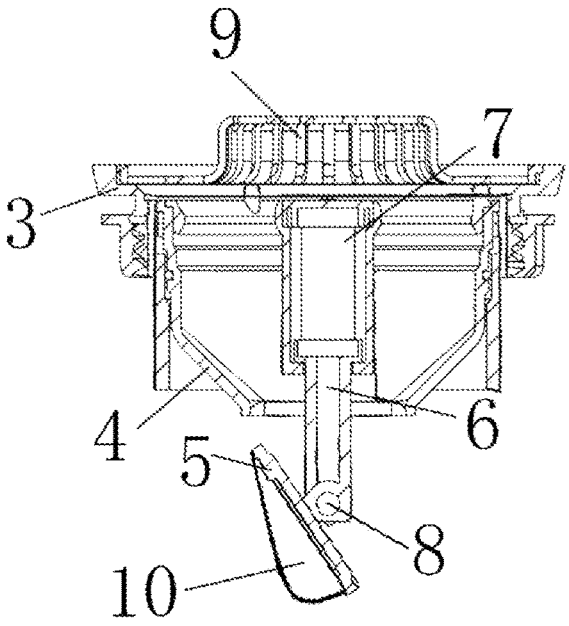
FIG. 3 is a diagram showing a guide component in a third state according to an embodiment.
Figure 4:
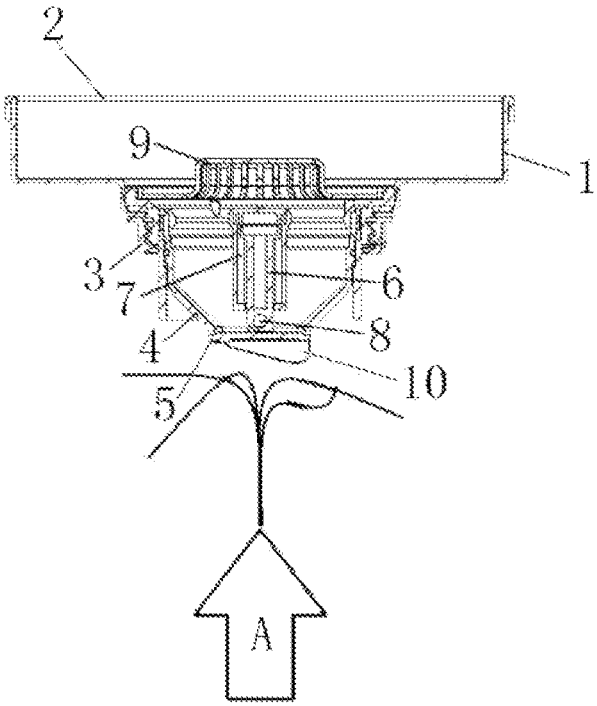
FIG. 4 is a diagram showing a guide component in a first state serving a function of splitting upward air flow according to an embodiment.
Figure 5:
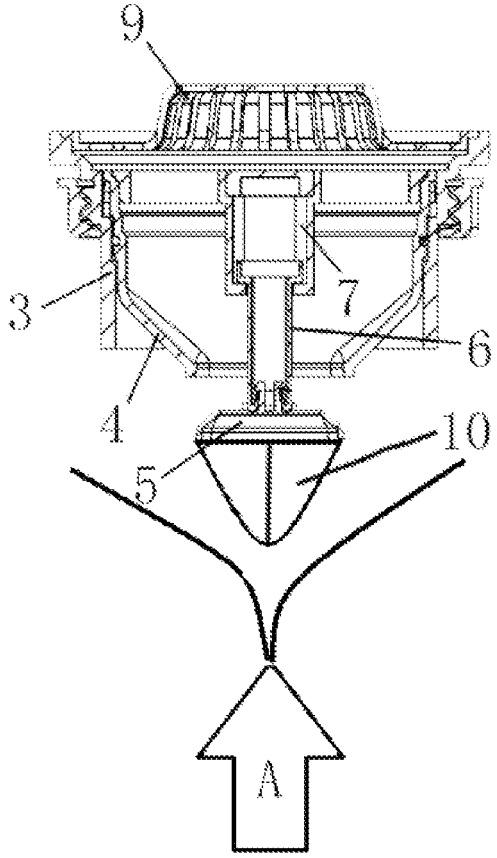
FIG. 5 is a diagram showing a guide component in a second state serving a function of splitting upward air flow according to an embodiment.
Figure 6:
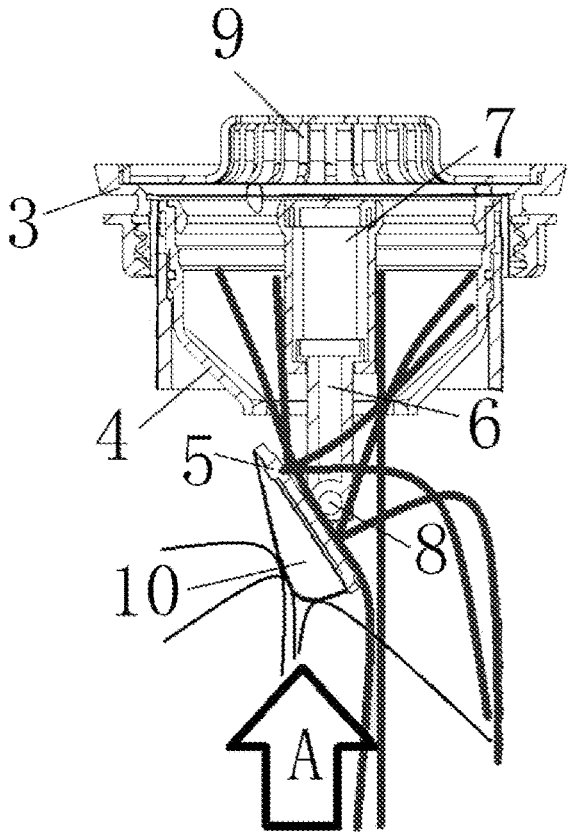
FIG. 6 is a diagram showing a guide component in a third state serving a function of splitting upward air flow according to an embodiment.

Further, the first direction means that left-right direction in FIG. 2, and the width of the first direction means that in the left-right direction. The maximum distance from the convex portion and the inclined plane to the sealing cover 5 is that from the convex portion and surface of the inclined plane to bottom of the sealing cover 5. Because distances to the sealing cover 5 are different, the convex portion and the inclined plane are not on the same horizontal plane, so that the convex portion and the inclined plane can better split the upward air flow.

Further, in some embodiments, an upper surface area of the guide component 10 is not less than bottom area of the sealing cover 5.

Further, the upper surface area of the guide component 10 is not less than bottom area of the sealing cover 5, so that the guide component 10 can guide the whole of the upward air flow, and the upward air flow will not press the sealing cover 5 to hinder the opening of the sealing cover 5. This further improves a guide effect of the guide component 10 on the upward air flow and use effect of the guide component 10.

Further, in some embodiments, the second guide surface is composed of one curved surface and/or one plane.

Further, the second guide surface is composed of one curved surface and/or one plane. Therefore, when upward air flow is guided by the second guide surface, guide surface with less surface-connecting lines can guide the air flow smoothly, thereby ensuring work stability of the sealing cover 5. However, the second guide surface with a single curved surface and/or single plane has less guide directions for the upward air flow, thereby decreasing guide effect of the guide component 10.

Further, in some embodiments, the second guide surface is composed of multiple curved surfaces and/or multiple planes.

Further, the second guide surface is composed of multiple curved surfaces and/or multiple planes. Therefore, when the upward air flow is guided by the second guide surface, the second guide surface with excessive surface-connecting lines can split upward air flow and have a strong guide result, thereby influencing opening of the sealing cover 5. However, the second guide surface with multiple curved surfaces and/or multiple planes can have more guide directions for guiding the upward air flow, thereby improving the guiding effect.

Further, in some embodiments, the water seal body assembly 4 is provided at a center with a chute 7 along an axis of the water seal body assembly, and the lifting rod 6 is provided in the chute 7.

Further, the lifting rod 6 is slidable in the chute 7, so that the lifting rod 6 operably drives the sealing cover 5 to move up and down, and in turn the sealing cover 5 can control switching of a lower opening of the water seal body assembly 4, thereby controlling the flowing of water.

Further, in some embodiments, the sealing cover 5 is provided at an upper center with an articulated base 8, and the articulated base 8 is defined with a rotating hole, which is hinged with a lower end of the lifting rod 6 via a pin shaft.

Further, the sealing cover 5 can be rotated around an axis of the pin shaft in a first direction relative to the lifting rod 6, so that the sealing cover 5 can be inclined, and inclined degree of the sealing cover 5 can be adjusted according to the amount of water flow to increase the drainage efficiency and improve the use effect of the sealing cover 5.

Further, in some embodiments, the water seal floor drain is switchable among a first state, a second state and a third state; in which

- when the water seal floor drain is in the first state, an upper end of the lifting rod 6 is positioned at an upper end of the chute 7; the sealing cover 5 and the guide component 10 are horizontal;
- when the water seal floor drain is in the second state, the upper end of the lifting rod 6 is slid to lower end of the chute 7; and the sealing cover 5 and the guide component 10 are horizontal; and
- when the water seal floor drain is in the third state, the upper end of the lifting rod 6 is slid to the lower end of the chute 7; and the sealing cover 5 and the guide component 10 are inclined.

Further, when the water seal floor drain is in the first state, the lifting rod 6 does not drive the sealing cover 5 to move downward, so that the sealing cover 5 will not open the lower end of the water seal body assembly 4, and the water seal floor drain is in a closed state and performs no function of drainage.

When the water seal floor drain is in the second state, the lifting rod 6 drives the sealing cover 5 to move downward, so that the sealing cover 5 opens the lower end of the water seal body assembly 4, and the guide component 10 at a lower end of the sealing cover 5 begins to guide the upward air flow in the drain, thereby preventing the upward air flow from affecting the opening of the sealing cover 5.

When the water seal floor drain is in the third state, the lifting rod 6 drives the sealing cover 5 to move downward, the sealing cover 5 opens the lower end of the water seal body assembly 4, and water flow drained from the water seal floor drain impacts the sealing cover 5, so that the sealing cover 5 and the guide component 10 are inclined to increase the opening of lower end of the water seal body assembly and accelerate the drainage efficiency, while the inclined guide component 10 can still guide the upward air flow from below, rather than interfering the drainage.

Further, when the guide component 10 guides the upward air flow, an upward force applied by the upward air flow on the convex portion can match a downward force caused by the upward air flow on the sealing cover 5, so that the sealing cover 5 can be better inclined and overturn, so as to increase an opening effect of the sealing cover 5 and the drainage effect in the present application.

Further, when the guide component 10 guides the upward air flow, an upward force applied by upward air flow on the inclined plane is less than that against the convex portion, so that the opening is usually positioned at one side of the inclined plane when the sealing cover 5 is opened. Therefore, positions of the inclined plane and the convex portion on both sides of the lifting rod 6 can be adjusted according to particular conditions in actual use, thereby achieving best drainage effect and enhancing applicability of the present application.

Embodiment 2

Figure 7:
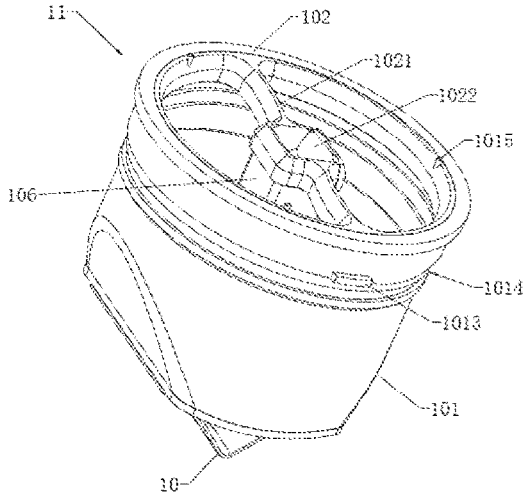
FIG. 7 is an overall structure diagram of a flow guide assembly according to an embodiment.
Figure 8:
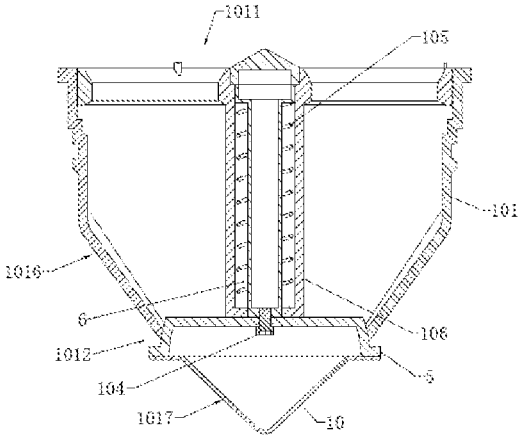
FIG. 8 is a section view of a flow guide assembly according to an embodiment.

This embodiment relatives to a flow guide assembly 11, which is used to guide the flow of gas or liquid (for example, water flow through a sewer). As shown in FIGS. 7-8, the flow guide assembly 11 includes a body 101, a holding part 102, a sliding component 106, a lifting rod 6, a sealing cover 5 and a guide component 10. The holding part 102 is positioned in the body 101, and configured for holding the flow guide assembly 11. The sliding component 106 is connected to the holding part 102. In some embodiments, the sliding component 106 and the holding part 102 are integrally formed with each other. The lifting rod 6 is slidably arranged in the sliding component 106. One end of the lifting rod 6 is slidably limited in the sliding component 106, and the other end is connected to the sealing cover 5. An end of the sealing cover 5 away from the lifting rod 6 is connected to the guide component 10.

The body 101 is hollow, which is convenient for fluid flow. A plurality of first guiding surfaces 1016 are provided inside the body 101 and protrude inwardly. An inner face of the first guiding surface 1016 is used to guide fluid, and an outer face is used to split air flow in cooperation with the guide component 10. The body 101 has open first end and second end. The first end can be of any shapes, as long as shape of the body is similar to and matches that of a pipe or a floor drain to be connected. The first end of the body 101 is formed with a first opening 1011. A sidewall of the second end is symmetrically recessed toward an axis of the body 101 to define a second opening 1012. The first end of the body 101 has a sectional area greater than that of the second end, that is, area of the first opening 1011 is greater than that of the second opening 1012.

Figure 9:
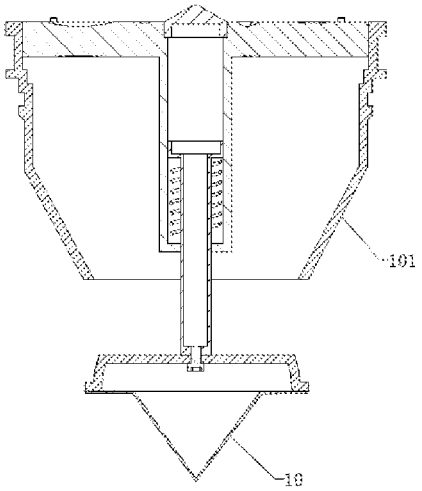
FIG. 9 is section view of a flow guide assembly according to another embodiment.

In some embodiments, as shown in FIG. 9, the first end of the body 101 is cylindrical, and a sidewall of the second end of the body 101 is recessed towards the axis of the body 101.

The guide component 10 is conical, and the guide component 10 and the second end of the body 101 form a bigger conical together.

As shown in FIG. 7, the holding part 102 is toroidal, having a peripheral wall fixedly connected to an inner circumferential wall of the first end of the body 101, for example, by bonding. The sliding component 106 is provided around the axis of the body 101, and fixedly connected to the inner circumferential wall of the holding part 102 through fixing rods 1021 respectively. In some embodiments, the fixing rods 1021 are circular arc, and there are two fixing rods. The two fixing rods 1021 are symmetrically arranged along a diameter direction of the body 101 and are integrally formed with each other. In some embodiments, the holding part 102 can be of other shapes, as long as shape of the holding part 102 matches that of the first end of the body 101.

As shown in FIG. 8, in some embodiments, the sliding component 106 is arranged along cylinder axis of the body 101, and integrally formed with the fixing rod 1021 and the holding part 102. A convex cover 1022 is provided at a connection portion of the sliding component 106 with the two fixing rods 1021 to close an open end of the sliding component 106, thereby preventing a fluid from entering the sliding component 106. The sliding component 106 is formed with a chute 7 along the axis of the body 101, and the lifting rod 6 is slidably arranged in the chute 7. The lifting rod 6 is hollow and assumes T-shape. Head portion of the T-shape is limited by an end of the chute 7 to prevent the lifting rod 6 from sliding out of the chute 7. A spring 105 is circumferentially sleeved around an outer wall of the lifting rod 6. The head portion of the T-shape of the lifting rod 6 is configure for compressing the spring 105, and the lifting rod 6 is enabled to slide up and down under compression and restoration of the spring 105. One end of the lifting rod 6 away from the head portion of the T-shape is connected to a sealing cover 5, for example, via a bolt 104. The sealing cover 5 is used to open and close the second opening 1012 of the body 101. The sealing cover 5 is tapered toward the lifting rod 6, with a portion thereof entering and closing the second opening 1012, so as to ensure a sealing performance of the sealing cover 5 when there is no fluid passing through. When fluid is drained, a pressure form the fluid acts on an upper surface of the sealing cover 5, so that the sealing cover 5 drives the lifting rod 6 downward, thereby opening the second opening 1012 while compressing the spring 105. After the fluid is drained, the pressure acts on the sealing cover 5 disappears, and the lifting rod 6 is lifted due to a restoring force of the spring 105, which drives the sealing cover 5 to close the second opening 1012 again.

In some embodiments, the lifting rod 6 is sleeved with other pulling structures, for example, a mechanical or electromagnetic pulling structure, as long as the lifting rod 6 can be slid up and down by the pulling structure. In some embodiments, the lifting rod 6 is sleeved with a spring.

In some embodiments, the guide component 10 is provided at a side of the sealing cover 5 departing from the lifting rod 6. A lower surface of the guide component 10 acts as a second guide surface 1017, which is a convex structure facing downward.

As shown in FIG. 8, the guide component 10 is bonded to one side of the sealing cover 5 away from the lifting rod 6, and a surface thereof away from the sealing cover 5 acts as the second guide surface 1017. In some embodiments, the second guide surface 1017 is a corner-shaped surface protruding from the sealing cover 5, for example, a V-shaped corner surface, so as to split air flow from below and reduce the interference of such air flow. The degree of the corner-shaped surface of the second guide surface 1017 can be the same as that of the first guide surface 1016. In some embodiments, the second guide surface 1017 is in line with an outer surface of the first guide surface 1016, so that there is a larger contact area for splitting the air flow from below.

Figure 10:
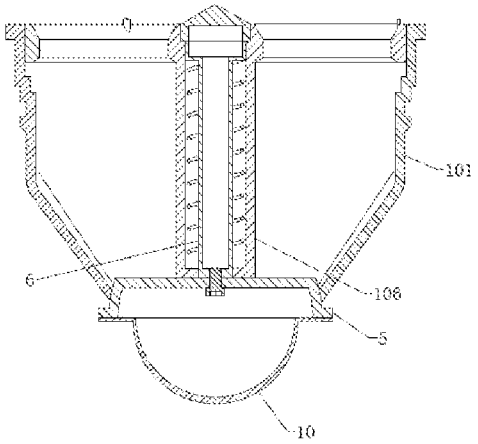
FIG. 10 is a structural view of a guide component assuming spherical convex shape according to an embodiment.
Figure 11:
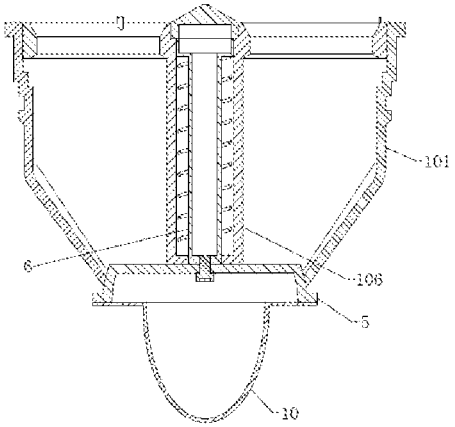
FIG. 11 is a structural diagram a guide component assuming ellipsoidal convex shape according to an embodiment.

As shown in FIG. 10-11, in some other embodiments, the second guide surface 1017 bulges as spherical, ellipsoidal or conical shape or the like in a direction away from the sealing cover 5. A section view of the flow guide assembly 11 in which the second guide surface 1017 bulges as spherical, ellipsoidal or conical shape is similar with FIG. 8, and thus is omitted.

As shown in FIG. 7, an outer sidewall of the body 101 close to the holding part 102 is symmetrically arranged with a snap block 1013 along axis thereof. An outer sidewall of the body 101 is circumferentially formed with a snap-in groove 1014 for a seal ring to snap in. An annular portion of the holding part 102 is provided with a plurality of connection bulges 1015 protruding toward the axis of the body 101. When the flow guide assembly 11 is connected to a pipe, a floor drain or the like, the snap-in groove 1014 and the snap block 1013 cooperate with each other to fix the position of the flow guide assembly 11 circumferentially, and the connection bulges 1015 is used to fix the position of the flow guide assembly 11 in the axis direction of the body 101. The flow guide assembly 11 according to the present application can be directly and conveniently connected to a pipe, a floor drain or the like.

An implementation principle of this embodiment is as follows. When a fluid, for example, gas or water, needs to be drained, the fluid passes through the first opening 1011 and enters the body 101, flowing toward the sealing cover 5. The sealing cover 5 is moved in the same direction as that the fluid flows due to an impact from the fluid, so that the fluid flows out of the second opening 1012. The sealing cover 5 drives the lifting rod 6 to slide down under pressure of the fluid, so that the head portion of the T-shape of the lifting rod 6 compresses the spring 105. At the same time, an air flowing from below, counter currently pressing the sealing cover 5, is split by the corner-shaped surface of the second guide surface 1017 and flows along the first guide surface 1016, thereby decreasing the countercurrent pressure on the sealing cover 5 and reducing the impact on the opening of the sealing cover 5, further reducing the influence on the flow speed of the fluid. When the drainage is finished, the lifting rod 6 is lifted under a restoring force of the spring 105, and drives the sealing cover 5 to close the second opening 1012 again.

The above are the preferred embodiments of the present application, which are not intended to limit the protection scope of the present application. Therefore, all equivalent changes made according to the structure, shape and principle of the present application should be covered within the protection scope of the present application.

LIST OF REFERENCE SIGNS

1. floor drain seat
2. floor drain cover
3. fixing body
4. water seal body assembly
5. sealing cover
6. lifting rod
7. chute
8. articulated base
9. strainer

10. guide component
A. upward air flow
11. flow guide assembly
101. body
102. holding part
1011. first opening
1012. second opening
1013. snap block
1014. snap-in groove
1015. connection bulge
1016. first guide surface
1017. second guide surface
1021. fixing rod
1022. cover
104. bolt
105. spring
106. sliding component

What is claimed is:

1. A flow guide assembly, comprising a body, a holding part, a sliding component, a lifting rod, a sealing cover and a guide component, wherein the body is hollow and provided with a plurality of first guiding surfaces bulging inwardly, the body has an open first end and an open second end, the holding part is positioned in the body and connected to the open first end of the body, the sliding component is connected to the holding part, the lifting rod is provided in the sliding component, a lower end of the lifting rod is connected to a first side of the sealing cover, a second side of the sealing cover is provided with a guide component, and a surface of the guide component away from the sealing cover defines a second guide surface and bulges toward a direction away from the sealing cover, the second guide surface is a corner-shaped surface protruding from the sealing cover, a degree of the corner-shaped surface of the second guide surface is the same as a degree of one of the plurality of first guiding surfaces.

2. The flow guide assembly according to claim 1, wherein the lifting rod is configured to slide up and down in the sliding component.

3. The flow guide assembly according to claim 2, wherein the lifting rod is configured as a T-shape and sleeved with a mechanical pulling structure or electromagnetic pulling structure.

4. The flow guide assembly according to claim 3, wherein the mechanical pulling structure or electromagnetic pulling structure is a spring.

5. The flow guide assembly according to claim 4, wherein a sidewall of the open second end is recessed toward an axis of the body.

6. The flow guide assembly according to claim 5, wherein opposite sidewalls of the open second end of the body are symmetrically recessed toward the axis of the body.

* * * * *